US005102511A

United States Patent [19]

Suwa et al.

[11] Patent Number: 5,102,511

[45] Date of Patent: Apr. 7, 1992

[54] METHOD OF DECONTAMINATING RADIOACTIVE METALLIC WASTES

[75] Inventors: Takeshi Suwa; Nobuhide Kuribayashi; Taketoshi Yasumune, all of Ibaraki, Japan

[73] Assignee: Japan Atomic Energy Research Institute, Japan

[21] Appl. No.: 527,893

[22] Filed: May 24, 1990

[30] Foreign Application Priority Data

Jun. 9, 1989 [JP] Japan ..... 1-147046

[51] Int. Cl.[5] ..... C25B 1/00; C23G 1/08

[52] U.S. Cl. ..... 204/93; 204/104; 204/130; 134/1; 134/3; 156/627

[58] Field of Search ..... 134/1, 3; 156/627; 204/93, 104, 130

[56] References Cited

U.S. PATENT DOCUMENTS 3,873,362 3/1975 Mihram et al. ..... 252/142
4,410,498 10/1983 Hatch et al. ..... 423/150
4,670,234 6/1987 Hölter et al. ..... 423/235

OTHER PUBLICATIONS

T. Suwa, Crud in Nuclear Power Plants, Corrosion Engineering, 37, 405–408 (1988).
R. F. S. Robertson, Chalk River Experience in 'Crud' Deposition Problems, Atomic Energy of Canada Limited, Aug. 15, 1961 (Partial), pp. 1 & 2.
Babcook & Wilcox Company, Plant Decontamination Methods Review, Electric Power Research Institute, May 1981, pp. ix, S-1-S-2, 3-1-3-3.
Metal Finishing Handbook, Jan. 1989, p. 159.

*Primary Examiner*—John Niebling
*Assistant Examiner*—David G. Ryser
*Attorney, Agent, or Firm*—Banner, Birch, McKie & Beckett

[57] ABSTRACT

This invention relates to a chemical method of effectively decontaminating metallic wastes that have been contaminated by radioactive substances and which have resulted from the demolition of nuclear power plants or reactors in operation. The method is that when the increase in the amount of dissolution of metal ions from the wastes causes the potential of the aqueous sulfuric acid to increase beyond a certain level, the dissolved metal ions are reduced electrolytically to control the potential of said aqueous sulfuric acid to become lower than said certain level.

4 Claims, 3 Drawing Sheets

$Ce^{4+}$ IN SC SOLUTION: 50mM

○、● : SUS304 ; △、▲ : SUS316 ; □、■ : INCONEL600

●、▲、■ : aq. $H_2SO_4$ ; ○、△、□ : SC SOLUTION

METHOD OF DECONTAMINATING RADIOACTIVE METALLIC WASTES

BACKGROUND OF THE INVENTION

This invention relates to a chemical method of decontaminating metallic wastes that have been contaminated by radioactive substances and which have resulted from the demolition of nuclear power plants or reactors in operation.

Metallic wastes contaminated with radioactive substances must be decontaminated to unrestricted levels before they are disposed of as non-radioactive wastes. To this end, many methods have been developed and two typical examples are an electro-polishing method in which an electric current is applied to the contaminated metallic waste to perform anodic dissolution and a mechanical method in which the metal surface is ground with a particulate abrasive. These methods have the advantage that satisfactory decontamination can be accomplished within a short period of time but on the other hand, their applicability is limited to metallic parts of simple shapes and it is usually difficult to decontaminate uniformly the surface of complexly shaped parts such as valves and pumps.

With a view to dealing with this problem, a chemical decontamination method has been proposed by which metal parts are decontaminated with solutions of various chemicals (i.e., decontaminates). A problem with this approach is that if a solution of an inorganic acid such as sulfuric acid or nitric acid is solely used as a decontaminant, the radioactive "crud" (radioactive corrosive product) on the metal surface as well as the base metal dissolve so slowly that it has been difficult to achieve a high decontamination factor (DF) within a short period of time.

In order to increase the speed at which the "crud" and the base metal dissolve, it has been proposed that a solution in which an oxidizer such as cerium ($Ce^{4+}$) or potassium permanganate ($KMnO_4$) is combined with an inorganic acid be used as a decontaminant. The present inventors previously developed a method that relied on this approach and achieved satisfactory decontamination by using sulfuric acid/cerium (SC) in solution (see Japanese Patent Public Disclosure Nos. 62-261099 and 63-235899). However, when the oxidizer ($Ce^{4+}$) is used to oxidize and dissolve the "crud" and base metal ($Fe^{2+} \rightarrow Fe^{3+} + e-$, $Cr^{3+} \rightarrow Cr^{VI} + 3e-$ and $Fe \rightarrow Fe^{3+} + 3e-$, $Cr \rightarrow Cr^{VI} + 6e-$, etc.), it is reduced ($Ce^{4+} + e- \rightarrow Ce^{3+}$) to lose its oxidizing and dissolving ability. It is therefore necessary to either supply an additional amount of the oxidizer that compensates for its consumption or regenerate the corresponding amount of oxidizer by electrochemical means. Further, if the concentration of dissolved metallic ions exceeds $1 \times 10^4$ ppm (1 kg/m$^3$), an increased amount of electric current must be applied in order to compensate for the drop in current efficiency which occurs during regeneration of the oxidizer. In an extreme case, complete replacement of the decontaminant solution is necessary but this causes the disadvantage of generating large quantities of liquid wastes from the operations of decontamination.

The present inventor found that in a certain concentration range of sulfuric acid, carbon steels or stainless steels (e.g. SUS 304 and 316) were corroded more rapidly by aqueous sulfuric acid than by sulfuric acid/cerium (SC) in solution. The results of an experiment conducted in this regard are shown in FIG. 1. The experiment was conducted in order to investigate the relationship between the concentration of sulfuric acid and the rate of corrosion (mdd, mg/dm$^2$.day) of stainless steels (SUS 304 and 316 ) and Inconel 600 (which are representative of the materials of which nuclear reactors are constructed) in aqueous sulfuric acid and sulfuric acid/cerium (SC) in solution. The corrosion test was performed by the following procedure: a predetermined concentration of aqueous sulfuric acid or SC in solution was placed in an amount of 700 ml in a 1-l glass separable flask and heated to 80° C.; thereafter, a metal test piece having a surface area of 22.4 cm$^2$ was immersed in the solution with stirring. The test piece had been polished with emery #400, degreased and cleansed. As is clear from FIG. 1, the rate of corrosion of the stainless steels (SUS 304 and 316) increased with the increasing concentration of sulfuric acid (●, ►) but the rate of corrosion of Inconel 600 was little susceptible to the concentration of sulfuric acid (♦). In the SC solution, the corrosion rate increased in proportion to the first order of the concentration of $Ce^{4+}$ but it was little susceptible to the concentration of sulfuric acid (o, Δ, □,). It is therefore clear that a stainless steel used as a base metal is corroded more rapidly by aqueous sulfuric acid than the SC solution if the concentration of sulfuric acid is held higher than a certain level, which is 0.7M for SUS 304 and 2.2M for SUS 316. However, Inconel 600 cannot be corroded with aqueous sulfuric acid at a sufficiently high rate and hence must be decontaminated with the SC solution. It was therefore established that stainless steels could be corroded at high rate with aqueous sulfuric acid having concentrations higher than certain levels. A similar experiment was conducted with carbon steels and sufficiently high corrosion rates (ca. $1 \times 10^5$ mdd) could be attained with 0.25M sulfuric acid at 80° C. In fact, however, metals contaminated with "cruds" could be corroded at fast rate only in the initial period of immersion in aqueous sulfuric acid and as time passed, the rate of corrosion slowed down and no high DF could be attained within a short period. Upon repeated use of the aqueous sulfuric acid in decontamination work, its capability as a decontaminant was eventually lost.

SUMMARY OF THE INVENTION

An object, therefore, of the present invention is to provide a decontamination method that uses aqueous sulfuric acid alone and which yet is capable of achieving high DF in a short period of time.

DETAILED DESCRIPTION OF THE INVENTION

Metals are corroded at high rates within certain ranges of potential. For example, the corrosion rate of a stainless steel (SUS 304) in aqueous sulfuric acid is at a maximum at potentials in the range of −0.2 to −0.4 volts (vs Ag/AgCl). Noting this fact, the present inventor conducted an experiment in which the potential of aqueous sulfuric acid used as a decontaminant was monitored and when it exceeded a certain level, the aqueous sulfuric acid was reduced electrolytically, principally involving the reaction of $Fe^{3+}+e \rightarrow Fe^{2+}$, so that its potential would be returned to the region that was capable of rapid corrosion. This technique was effective in removing large amounts of contaminants with a small volume of aqueous sulfuric acid. In other words, the present inventor found that high corrosion rates could be attained by controlling the potential of aqueous sulfuric acid to be held below certain level and the present invention has been accomplished on the basis of this finding.

The present invention relates to a method of stripping or removing a radioactive "crud" and dissolving the surface of a base metal to thereby decontaminate radioactive metal wastes that are immersed in aqueous sulfuric acid, which method is characterized in that when the increase in the amount of dissolution of metal ions from the "crud" and the base metal causes the potential of the aqueous sulfuric acid to increase beyond a certain level, the dissolved metal ions are reduced electrolytically to control the potential of said aqueous sulfuric acid to become lower than said certain level.

Figure 1:
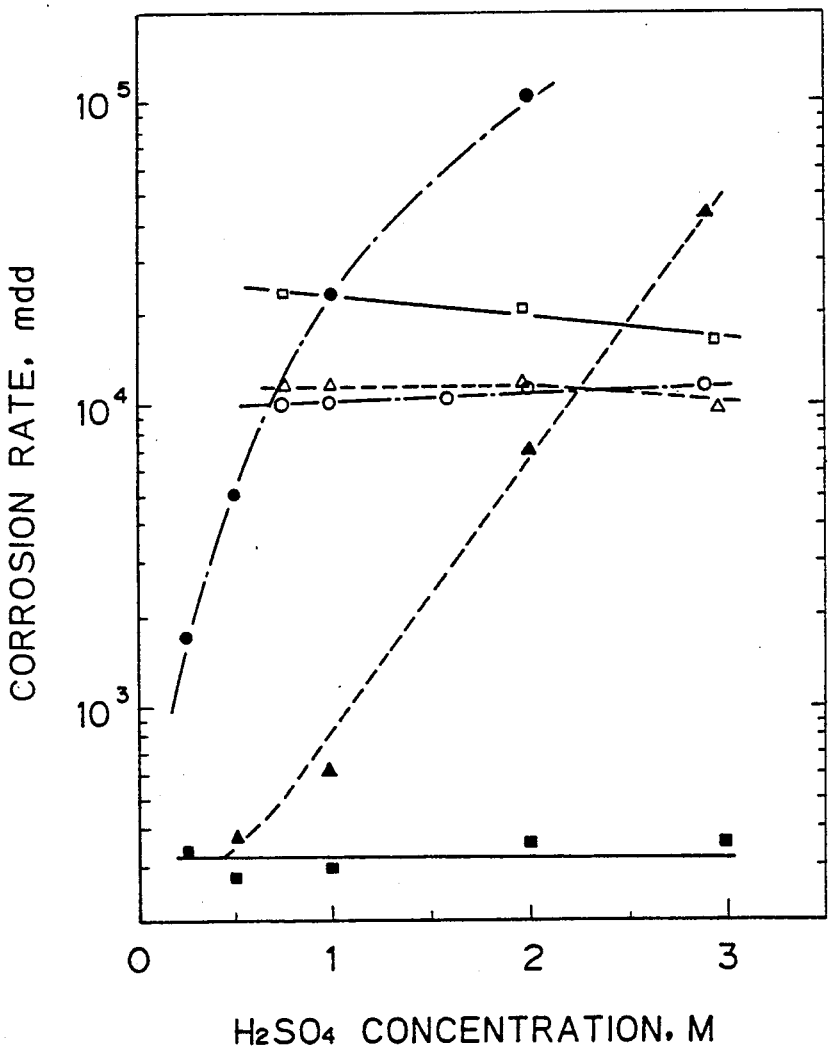
FIG. 1 is a graph showing the relationship between the concentration of sulfuric acid and the rate of corrosion of stainless steels (SUS 304 and 316) and Inconel 600 in aqueous sulfuric acid and in a sulfuric acid/cerium (SC) solution.

In accordance with the present invention, a metal contaminated with radioactivity is immersed in aqueous sulfuric acid, whereupon the "crud" on the metal surface is dissolved or stripped away as the base metal dissolves. The distribution of radioactive nuclides is such that they diffuse not only in the surface "crud" layer but also into the bulk of the base metal to a certain extent. When wastes that result from the demolition of nuclear reactors are to be throughly decontaminated to unrestricted levels, it is required that the base metal be dissolved away to a thickness of several tens of microns beneath the surface. The thickness, d (μm), by which the base metal is dissolved away is expressed by the following formula:

$$d=10^{-2}R_c t/2.4\rho$$

where $R_c$ is the rate of corrosion of the base metal (mdd, mg/dm$^2$.day), t is the time of dissolution (h), and $\rho$ is the density of the base metal (in the case of a stainless steel, $\rho \simeq 8$ g/cm$^3$). As the above formula shows, the greater the value of $R_c$, the shorter the time that is required to dissolve away a certain thickness of the base metal. For instance, the time required to dissolve away a thickness (d) of 50 μm is ca. 10 hours when $R_c=1\times10^4$ mdd, and ca. 1 hour when $R_c=1\times10^5$ mdd. As FIG. 1 shows, SUS 304 contaminated with radioactive "cruds" can in most cases be decontaminated within an hour or so with 2M sulfuric acid at 80° C. since the $R_c$ under this condition is approximately $1\times10^5$ mdd.

The higher the concentration of aqueous sulfuric acid, the higher the dissolution rate of the base metal. On the other hand, the load on the treatment of liquid wastes increases with the increasing concentration of sulfuric acid. Therefore, the preferred range of sulfuric acid concentration is from 0.5 to 3 mol/l. The aqueous sulfuric acid is generally held at least room temperature, with the range of 50°-90° C. being preferred. The potential of the aqueous sulfuric acid varies somewhat depending upon the concentration of dissolved metal ions and on the temperature but it is preferably controlled to be no more than 0.1-0.2 volts.

Japan has no specific regulations on the unrestricted levels of contamination of machines and equipment in demolished nuclear reactors, but efforts are being made in Great Britain and France to develop effective methods of decontaminating nuclides with the target unrestricted level being set at no more than 0.4 Bq/g and 1 Bq/g, respectively. The results of the decontamination experiments described above show that these requirements for unrestricted level are reasonably satisfied by the method of the present invention.

The surface of a metal that has been decontaminated with aqueous sulfuric acid is covered with a black deposit generally called "crud", which gives it a dirty appearance. In order to provide the metal with a clean surface, it may be desmutted by being re-immersed in the decontaminant aqueous sulfuric acid after the latter has been oxidized electrolytically to have a potential of at least 0.3 volts at which the corrosion of the base metal is retarded. The same result can be attained by immersing the metal in a sulfuric acid/cerium solution. There are no particular limitations on the nature of the sulfuric acid/cerium solution in which the metal is to be immersed, except that the concentration of sulfuric acid suffices to be as low as about 0.25M and that the cerium need be a mixture of $Ce^{4+}$ and $Ce^{3+}$ ($Ce^{4+}/Ce^{3+}\simeq1$ and $Ce^{4+}\simeq$5-10 mM). If either $Ce^{4+}$ or $Ce^{3+}$ is used alone, the metal can be desmutted but it is difficult to provide a clean surface.

The following examples are provided for the purpose of further illustrating the present invention but are in no way to be taken as limiting.

EXAMPLE 1

Figure 2:
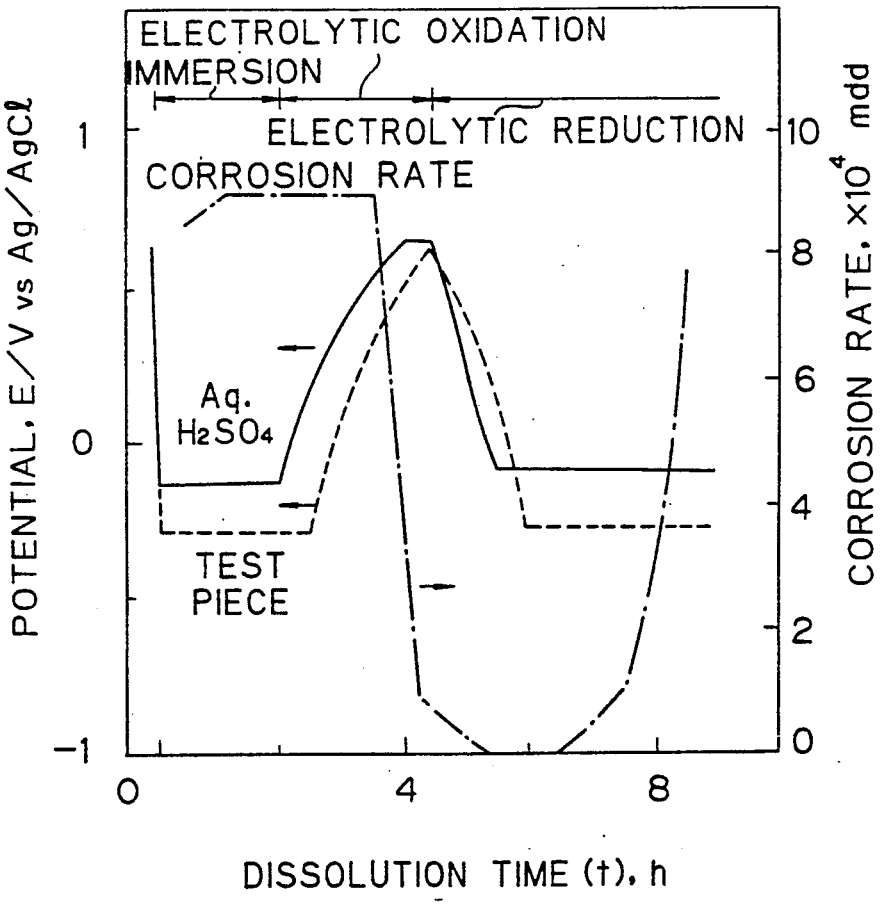
FIG. 2 is a graph showing the time-dependent changes in the potentials of aqueous sulfuric acid and a test piece immersed in it and in the rate of its corrosion.

A test piece (SUS 304) was immersed in aqueous sulfuric acid (1.8M, 80° C.) and the time-dependent changes in the potentials of the test piece and the aqueous sulfuric acid and in the concentrations of dissolved metal ions (Fe, Cr and Ni) were investigated. The results were as shown in FIG. 2. The test piece used in this experiment and the volume of aqueous sulfuric acid were the same as those employed in the experiment shown in FIG. 1. An Ag/AgCl reference electrode was inserted in order to measure the potentials of the test piece and the aqueous sulfuric acid (potentials at a Pt electrode). As is clear from FIG. 2, the potentials of the test piece and the aqueous sulfuric acid dropped (shifted in the less noble direction) to ca. −0.3 V and ca. 0.1 V, respectively, as soon as the dissolution of the test piece started in the aqueous sulfuric acid. The rate of corrosion of the test piece on this occasion was ca. $8\times10^4$ mdd. When the aqueous sulfuric acid was later oxidized electrolytically to provide a higher (noble) potential of ca. 0.6 V, the potential of the test piece also increased, causing a rapid decrease in the rate of its corrosion. However, when the aqueous sulfuric acid was reduced electrolytically to provide a lower (base) potential, the corrosion rate of the test piece started to increase again. These experimental results show that the rate at which stainless steels are corroded can be significantly increased by proper control of the potential of the aqueous sulfuric acid in which they are immersed.

EXAMPLE 2

A decontamination test was conducted with contaminated test pieces from an operating nuclear reactor being immersed in aqueous sulfuric acid. The test pieces were sampled from the purifying piping in the reactor. They had a "crud" deposited in an amount of ca. 0.5 $mg/cm^2$ that consisted of ca. 20% Cr, 28% Ni and 50% Fe. The test piece used in one test run had the "crud" deposited over an area of ca. 5 $cm^2$, with the total deposit area being ca. 17 $cm^2$.

Figure 3:
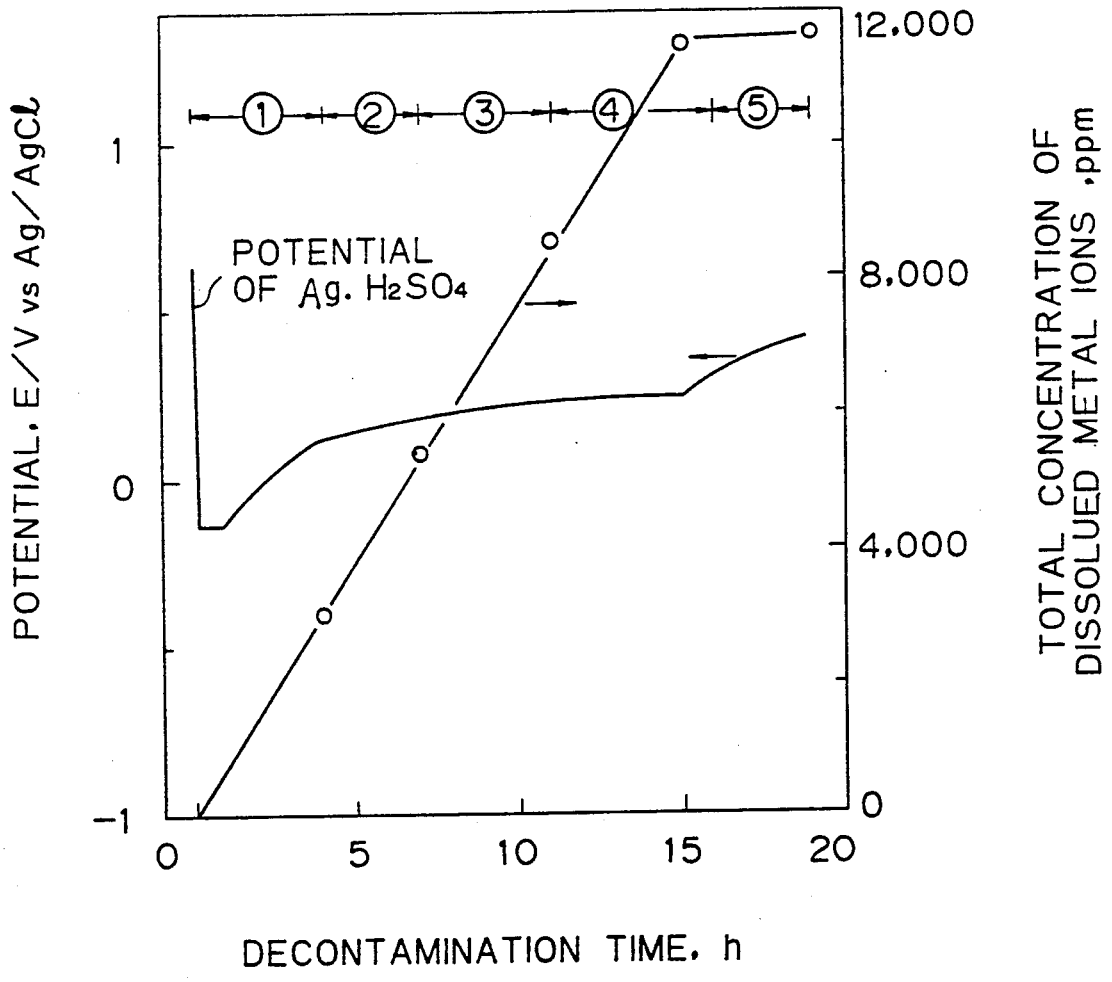
FIG. 3 is a graph showing the time-dependent changes in the potentials of aqueous sulfuric acid in which a contaminated test piece from a nuclear reactor was immersed for decontamination and in the concentration of dissolved metal ions.

A separable flask of the same type as what was used in the experiment the result of which is shown in FIG. 1 was charged with 700 ml of 1.8M sulfuric acid. After the aqueous sulfuric acid was heated to 80° C., one test piece was immersed therein for decontamination. Thereafter, another test piece was immersed in the same solution (i.e., not replaced with a fresh solution) and the same procedure was repeated for the remaining test pieces. The time-dependent changes in the potential of the aqueous sulfuric acid and the total concentration of the dissolved metal ions (Fe+Cr+Ni) that occurred in the cyclic decontamination procedures are shown in FIG. 3, in which the respective cycles of decontamination are denoted by (1) to (5). In the actual sample of decontaminated object to be treated, the base metal has a metal oxide deposit as a "crud" which, when dissolved in aqueous sulfuric acid, will release both a ferrous ($Fe^{2+}$) and a ferric ($Fe^{3+}$) ion. As is clear from FIG. 3, the potential of aqueous sulfuric acid dropped rapidly to ca. −0.1 V as soon as the first test piece was immersed in it (cycle 1). The potential of the aqueous sulfuric acid thereafter rose gradually unit it reached 0.24 V at the end of cycle 4, when the total concentration of dissolved metal ions was $1.15\times10^4$ ppm ($Fe^{2+}$, 7600 ppm; $Fe^{3+}$, 1050 ppm; $Cr^{3+}$, 2050 ppm, Ni, 1000 ppm). Up to the forth cycle of decontamination, the rate of corrosion of the test pieces remained as high as at least $7.4\times10^4$ mdd. However, in cycle 5, the potential of the aqueous sulfuric acid rose to ca. 0.4 V, allowing the corrosion rate to drop to 220 mdd.

The results of the decontamination test described are shown in Table 1.

TABLE 1

Decontamination of Test Pieces from Nuclear Reactor

| No. | Before decontamination Surface contamination of radioactivity Bq/cm² | After decontamination Surface contamination of radioactivity Bq/cm² | DF — | After ultrasonic cleaning Surface contamination of radioactivity Bq/cm² | DF — |
|---|---|---|---|---|---|
| (1) | 950 | 0.43 | 2200 | <D.L. | 6300 |
| (2) | 660 | 0.60 | 1100 | <D.L. | 4400 |
| (3) | 610 | 0.76 | 800 | <D.L. | 4100 |
| (4) | 700 | 1.4 | 510 | <D.L. | 4700 |
| (5) | 830 | 700 | 1.2 | 380 | 2.2 |

D.L.: detection limit = 0.15 $Bq/cm^2$

The surface of an as-decontaminated base metal has radioactive nuclides deposited thereon after having been dissolved in the aqueous sulfuric acid. As Table 1 shows, such nuclide deposit can be removed by ultrasonic cleaning in desalted water, with a further reduction being achieved in the decontamination level.

The decontamination factor (DF) generally decreases with the increase in the number of decontamination cycles but as Table 1 shows, the DF after ultrasonic cleaning could be maintained above 4000 up to cycle 4. In cycle 5, the potential of the aqueous sulfuric acid became so high that the rate of corrosion of the base metal was insufficiently low to achieve high DF.

The results of Example 2 show that if the potential of aqueous sulfuric acid used as a decontaminant rises close to 0.2 V in the course of decontamination, it may be reduced electrolytically to have its potential reduced so that the decontamination procedure can be continued without replacing the decontaminant by a fresh one. This leads to a significant reduction in the generation of liquid wastes from the operations of decontamination.

The present invention has been described above with reference to stainless steels but it will be apparent to one skilled in the art that the method of the present invention can also be effectively applied to carbon steels.

As described on the foregoing pages, the method of the present invention insures that the potential of aqueous sulfuric acid will not increase beyond a certain level by reducing dissolved metal ions electrolytically and this offers the advantage that a high decontamination effect can be achieved within a short period of time since the rate of corrosion of a base metal will not drop to an undesirably low level. Further, the method of the present invention can be operated without using an oxidant and this not only simplifies the decontamination process but also facilitates the treatment of liquid wastes.

What is claimed is:

1. A method of stripping or removing a radioactive "crud" and dissolving the surface of a base metal to thereby decontaminate radioactive metal wastes said method comprised of immersing the base metal in aqueous sulfuric acid and characterized in that when the increase in the amount of dissolution of metal ions from the "crud" and the base metal causes the potential of the aqueous sulfuric acid to increase beyond a certain level, the dissolved metal ions are reduced electrolytically to control the potential of said aqueous sulfuric acid to become lower than said certain level.

2. A method according to claim 1 wherein the potential of said aqueous sulfuric acid is controlled to be not higher than 0.2 V.

3. A method according to claim 1 wherein said aqueous sulfuric acid has a concentration of 0.5–3 mol/l and is held in the range of from room temperature to 90° C.

4. A method according to claim 1 wherein the base metal is recovered from said aqueous sulfuric acid and then immersed in aqueous sulfuric acid adjusted to have a potential of at least 0.3 V.

* * * * *